US008842112B2

(12) United States Patent
Takasugi et al.

(10) Patent No.: US 8,842,112 B2
(45) Date of Patent: Sep. 23, 2014

(54) IMAGE DISPLAY DEVICE AND DRIVING METHOD OF THE SAME

(75) Inventors: Shinji Takasugi, Kanagawa (JP); Taro Hasumi, Kanagawa (JP)

(73) Assignee: LG Display Co., Ltd., Seoul (KR)

( * ) Notice: Subject to any disclaimer, the term of this patent is extended or adjusted under 35 U.S.C. 154(b) by 669 days.

(21) Appl. No.: 12/597,884

(22) PCT Filed: Mar. 28, 2008

(86) PCT No.: PCT/JP2008/056135

§ 371 (c)(1),
(2), (4) Date: Jan. 25, 2010

(87) PCT Pub. No.: WO2008/136229

PCT Pub. Date: Nov. 13, 2008

(65) Prior Publication Data

US 2010/0134479 A1 Jun. 3, 2010

(30) Foreign Application Priority Data

Apr. 27, 2007 (JP) ..... 2007-119010

(51) Int. Cl.
*G09G 5/00* (2006.01)
*G09G 3/32* (2006.01)

(52) U.S. Cl.
CPC ..... *G09G 3/3233* (2013.01); *G09G 2320/043* (2013.01); *G09G 2300/0842* (2013.01); *G09G 2310/0256* (2013.01)
USPC ..... 345/214; 345/76; 345/77; 345/92

(58) Field of Classification Search
CPC ..... G09G 3/3233; G09G 2300/0842; G09G 2310/0256; G09G 2320/043
USPC ..... 345/36–53, 63–64, 76–97, 204–215, 345/690
See application file for complete search history.

(56) References Cited

U.S. PATENT DOCUMENTS 7,742,025 B2 6/2010 Sung et al.
8,068,078 B2 11/2011 Lee et al.
(Continued)

FOREIGN PATENT DOCUMENTS

JP 2004-118132 A 4/2004
JP 2005-164894 A 6/2005
(Continued)

OTHER PUBLICATIONS

S. Ono et al., "Pixel Circuit for a-Si AM-OLED" Proceedings of IDW, 2003, pp. 255-258.

*Primary Examiner* — Amare Mengistu
*Assistant Examiner* — Vinh Lam
(74) *Attorney, Agent, or Firm* — Birch, Stewart, Kolasch & Birch, LLP

(57) ABSTRACT

An image display device equalizes an amount of shift in $V_{th}$ of a driving element for each pixel. Provided are a light-emitting element (D1) that emits light corresponding to current flowing therethrough; a driving element (Q1) that is connected to the light-emitting element (D1) and controls light emission of the light-emitting element (D1); and a controller (U1) that detects a threshold voltage of the driving element (D1) and controls an applied voltage to the driving element (D1) based on the detected threshold voltage. The controller (U1) applies voltages for a reverse or forward bias to the driving element (D1) based on a comparison result between the threshold voltage and a predetermined threshold when the light-emitting element (D1) does not emit light.

4 Claims, 8 Drawing Sheets

(56) References Cited

U.S. PATENT DOCUMENTS

| | | | | |
|---|---|---|---|---|
| 2004/0061671 | A1 | 4/2004 | Kawasaki et al. | |
| 2005/0083270 | A1* | 4/2005 | Miyazawa | 345/76 |
| 2006/0092185 | A1 | 5/2006 | Jo et al. | |
| 2006/0187154 | A1* | 8/2006 | Tsuchida | 345/76 |
| 2006/0238475 | A1* | 10/2006 | Oh | 345/92 |
| 2006/0267886 | A1* | 11/2006 | Ozaki et al. | 345/76 |
| 2007/0080908 | A1* | 4/2007 | Nathan et al. | 345/77 |
| 2007/0115225 | A1* | 5/2007 | Uchino et al. | 345/76 |
| 2008/0007547 | A1 | 1/2008 | Hasumi et al. | |
| 2008/0093994 | A1 | 4/2008 | Le Roy et al. | |
| 2008/0143653 | A1* | 6/2008 | Shishido | 345/78 |

FOREIGN PATENT DOCUMENTS

| | | | |
|---|---|---|---|
| JP | 2005-196114 | A | 7/2005 |
| JP | 2006-119179 | A | 5/2006 |
| JP | 2006-208966 | A | 8/2006 |
| JP | 2007-102215 | A | 4/2007 |
| JP | 2007-202126 | A | 8/2007 |
| WO | WO-2005/071648 | A1 | 8/2005 |
| WO | WO 2006/070833 | A1 | 7/2006 |

* cited by examiner

IMAGE DISPLAY DEVICE AND DRIVING METHOD OF THE SAME

TECHNICAL FIELD

The present invention relates to an image display device and a driving method of the same.

BACKGROUND ART

Recently, image display and illumination devices using electroluminescence light-emitting elements (hereinafter, referred to as "light-emitting elements") have attracted many scientists.

In particular, image display devices are made up of a plurality of pixels each including a light-emitting element that emits light corresponding to a predetermined current value. Each pixel includes a thin film transistor (TFT) that controls the luminance of the light-emitting element. The TFT is made from, for example, amorphous silicon or polysilicon.

Long-time use of the TFT made from amorphous silicon (a-Si TFT) results in increase in the gate threshold voltage (hereinafter, referred to as "$V_{th}$"). The increase is called "$V_{th}$ shift" of a-Si TFT. The rate of progression of $V_{th}$ shift depends on application and operational conditions of the a-Si TFT.

For example, the progression of $V_{th}$ shift of an a-Si TFT used as a switch as in a liquid-crystal display is slow because pulse current flows through the a-Si TFT for a given short time. On the other hand, the progression of $V_{th}$ shift of an a-Si TFT used as a driving element for an organic light-emitting element as in an organic light-emitting image display panel is fast because high constant current flows through the a-Si TFT.

The $V_{th}$ shift of a-Si TFT has two adverse effects on images. One effect is that different progression of $V_{th}$ shift from one pixel to another deteriorates image uniformity. The other effect is that large $V_{th}$ shift results in out of detection range of $V_{th}$ and reduced pixel luminance.

On the other hand, known circuit technology is called $V_{th}$ compensation (for example, Non-patent Document 1). According to this technology, a circuit configured to detect $V_{th}$ shift of a-Si TFT and superimpose a video signal on the $V_{th}$ shift obtains uniform images independently of the variation of Vth. It is known that performing Vth compensation can reduce the effects of Vth by a factor of about 5 to 10.

Non-patent Document 1: S. Ono et al., Proceedings of IDW '03, 255 (2003)

DISCLOSURE OF INVENTION

Problem to be Solved by the Invention

However, the $V_{th}$ compensation is applied to a limited range, and $V_{th}$ being out of the range results in rapid progression of the changes of pixel luminance due to $V_{th}$ changes.

Even if the variation of $V_{th}$ is within the compensation range, it is difficult to perform appropriate $V_{th}$ compensation in every pixel because the progression of $V_{th}$ shift differs from one pixel to another.

Means for Solving Problem

An image display device according an aspect of the present invention includes a light-emitting element that emits light corresponding to current flowing therethrough; a driving element that is connected to the light-emitting element and controls light emission of the light-emitting element; and a control unit that detects a threshold voltage of the driving element and controls an applied voltage to the driving element based on the detected threshold voltage. The control unit applies voltages for a reverse or forward bias to the driving element based on a comparison result between a threshold voltage and a predetermined threshold when the light-emitting element does not emit light.

A driving method according another aspect of the present invention is of an image display device that comprises a light-emitting element that emits light corresponding to current flowing therethrough, and a driving element that is connected to the light-emitting element and controls light emission of the light-emitting element. The driving method includes the steps of: causing the light-emitting element to emit light; detecting a threshold voltage of the driving element; and applying voltages for a reverse or forward bias to the driving element based on a comparison result between a threshold voltage and a predetermined threshold when the light-emitting element does not emit light.

Effect of the Invention

According to an image display device and a driving method of the same, it is possible to prevent the threshold voltage of the driving element from being out of the detection range, thereby improving the reliability of the pixel circuit.

According to an image display device and a driving method of the same, an amount of shift in a threshold voltage is equalized for each pixel and thus it is possible to improve image uniformity in the image display device.

EXPLANATIONS OF LETTERS OR NUMERALS

D1, D2, D3, D4 Light-emitting element
Q1, Q2, Q3*a*, Q4 Driving element
Q3*b* Switching element
U1, U2, U3, U4 Controller

BEST MODE(S) FOR CARRYING OUT THE INVENTION

Preferred embodiments of an image display device and a driving method of the same is explained in detail below with reference to the drawings. The present invention is not limited to the embodiments described below.

An image display device according to an embodiment includes a plurality of pixel circuits that are arranged in matrix and each pixel circuit includes an light-emitting element and a driving element.

Figure 1:
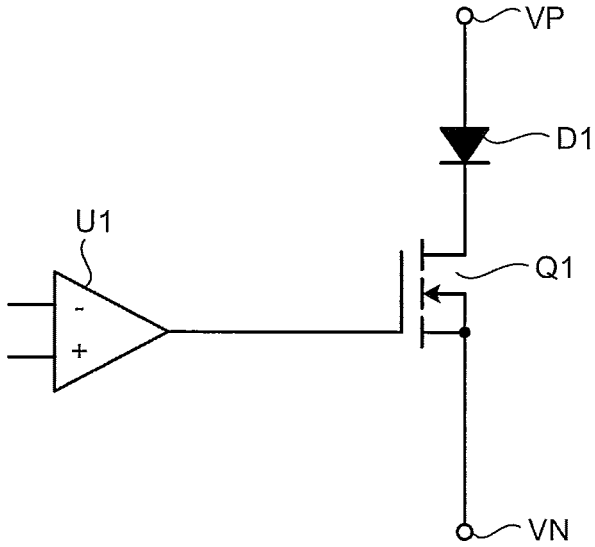
FIG. 1 shows an example configuration of a pixel circuit corresponding to a single pixel in an image display device according to a preferred embodiment of the present invention.

FIG. 1 shows a pixel circuit corresponding to a single pixel in an image display device according to a preferred embodiment of the present invention. To facilitate understanding of operations of a driving element Q1, the pixel circuit shown in FIG. 1 is simplified.

The pixel circuit shown in FIG. 1 includes a light-emitting element D1, the driving element Q1 that is connected to the light-emitting element D1 in series, and a controller U1 that controls the driving element Q1. The driving element Q1 is a transistor such as an a-Si TFT. The light-emitting element D1 is, for example, an organic light-emitting element. The anode end of the light-emitting element D1 is connected to a terminal from which a higher applied voltage is supplied (hereinafter, referred to as a "VP terminal"), and the cathode end is connected to the drain terminal of the driving element Q1. On the other hand, the source terminal of the driving element Q1 is connected to a terminal from which a lower applied voltage is supplied (hereinafter, referred to as a "VN terminal"), and the gate terminal is connected to an output terminal of the controller U1. The controller U1 is a control means that controls the gate voltage of the driving element Q1 to apply voltages for the reverse bias to the driving element Q1. The controller U1 includes, for example, one or more TFTs, capacitive elements such as capacitors, control lines for control of the TFT, and image signal lines for application of an image signal potential. The connection configuration shown in FIG. 1 is a "voltage control" configuration in which the light-emitting element D1 is connected to the drain terminal of the driving element Q1 and the gate terminal of the driving element Q1 is controlled, and is called "gate control and drain drive".

Operations of the pixel circuit shown in FIG. 1 is explained below. The pixel circuit, which includes the light-emitting element, generally operates through four periods: a preparation period, a $V_{th}$ detection period, a write period, and an emission period.

First, in the preparation period, a predetermined amount of charges is accumulated in the light-emitting element D1 (actually, parasitic capacitance of the light-emitting element D1 in itself). The reason why the charges are accumulated in the light-emitting element D1 in the preparation period is because to supply current between the drain and source of the driving element Q1 when $V_{th}$ of the driving element Q1 is detected until the current reaches zero.

Next, in the $V_{th}$ detection period, the VP terminal and the VN terminal are set to substantially the same potential, and the gate-source voltage $V_{th}$ of the driving element Q1 at the setting time is stored and held in, for example, a capacitive element (not shown) in the controller U1. This means the detection of $V_{th}$. The operation of storing and holding the $V_{th}$ in the capacitive element is performed by using the charges accumulated in the light-emitting element D1 in the preparation period.

After that, in the write period, a predetermined voltage obtained by superimposing an image data signal on the $V_{th}$ detected in the $V_{th}$ detection period is stored and held in, for example, a capacitive element not shown in the controller U1, where this capacitive element may be the same as or different from that for storing and holding the $V_{th}$.

Finally, in the emission period, the predetermined voltage stored and held in the write period is applied to the driving element Q1, so that the emission of the light-emitting element D1 is controlled.

The controller U1 controls current flowing through the light-emitting element D1, in accordance with a predetermined sequence that defines the series of operations. The luminance (gradation), hue, and saturation of each pixel of the image display device are set to their appropriate values by this control.

Figure 2:
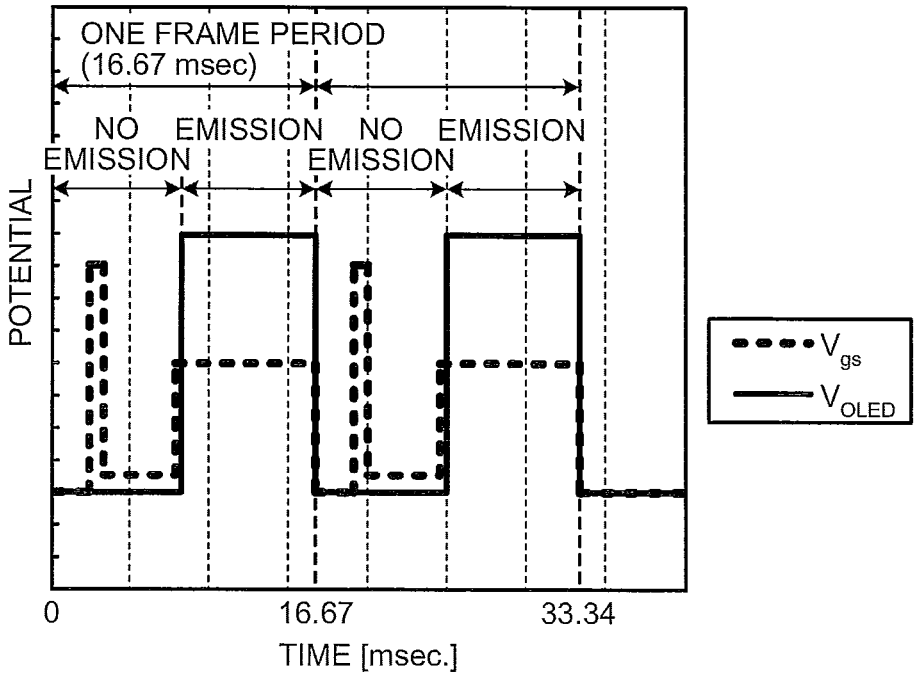
FIG. 2 shows an example of a driving waveform for performing emission/non-emission control of a light-emitting element.

The operations of the controller U1 according to the present invention is explained below with reference to FIGS. 1 and 2. FIG. 2 shows an example of a driving waveform for performing emission/non-emission control of the light-emitting element.

In FIG. 1, the controller U1 controls voltages for the forward bias or voltages for the reverse bias to be applied to the driving element Q1 while the light-emitting element D1 is not emitted. This control may be performed every frame period or while the image display device is not used. The control is described in detail later.

Here, the frame period is defined as a period in which an image to be displayed in a display panel of the image display device is rewritten. For example, one frame period of a display panel driven at 60 Hz is 16.67 ms (see FIG. 2). In general, during a frame period of 16.67 ms, a sequence that the light-emitting element D1 emits based on the driving voltage that depends on a level of gradation level, is repeated.

$V_{gs}$ represented by the dashed line in FIG. 2 is a potential difference between the gate and source of the driving element (a gate-source voltage), $V_{OLED}$ represented by the solid line is a potential deference between the anode and cathode of the light-emitting element D1. As shown in FIG. 2, the light-emitting element D1 is driven at a period of 16.67 ms (60 Hz), so that non-emission and emission operation is alternately performed in the period.

The No use of the image display device means the state where no image data is supplied to every pixel circuits and no current flows through all light-emitting elements.

If the driving element Q1 is an n-type transistor, the application of the voltages for the reverse bias generally means that the gate-source voltage $V_{gs}$ (=gate potential $V_g$−source potential $V_s$) of a transistor becomes lower than the threshold voltage $V_{th}$ of the transistor.

If the driving element Q1 is a p-type transistor, the application of the voltages for the reverse bias generally means that the gate-source voltage $V_{gs}$ (defined as that in the n-type transistor) of a transistor becomes higher than the threshold voltage of the transistor.

For example, if it is an n-type transistor that has a threshold voltage $V_{th}$ of 2 (V) and whose gate potential $V_g$, drain potential $V_d$, and source potential $V_s$, are −3 (V), 10 (V), and 0 (V), respectively, it is in a state where voltages for the reverse bias is applied because $V_{gs}=V_g-V_s=-3$ (V) and $V_{gs}-V_{th}=-5$ (V)<0 (V). The value of the voltages for the reverse bias is represented by the value of $V_{gs}$.

According to the definition of the voltages for the reverse bias, whether the voltages applied to the driving element Q1 corresponds to voltages for the reverse bias depends on the value of the threshold voltage $V_{th}$. A method of obtaining $V_{th}$ of the driving element Q1 made up of a TFT is explained below as exemplified by an n-type transistor.

As shown in the above representation, the gate-source voltage, drain-source voltage, and threshold voltage of the driving element Q1 are represented by $V_{as}$, $V_{ds}$ (=drain potential $V_d$−source potential $V_s$), and $V_{th}$, respectively. The current flowing through the TFT is also represented by $I_{ds}$. Here, $I_{ds}$ is approximated by the following equations for their respective saturation and linear regions.

$$\text{(a) } I_{ds}=\beta\times[(V_{gs}-V_{th})^2],\ \text{if } V_{gs}-V_{th}<V_{ds}\text{(saturation region)} \quad (1)$$

$$\text{(b) } I_{ds}=2\times\beta\times[(V_{gs}-V_{th})\times V_{ds}-(\tfrac{1}{2}\times V_{ds}^2)],\ \text{if } V_{gs}-V_{th}\geq V_{ds}\text{(linear region)} \quad (2)$$

Here, β in the equations (1) and (2) is a characteristic coefficient of the driving element Q1, and is represented by the following equation:

$$\beta=\tfrac{1}{2}\times W\times\mu\times C_{OX}/L \quad (3)$$

where W (cm), L (cm), $C_{OX}$ (F/cm$^2$), and μ (cm$^2$/$V_s$) of the driving element Q1 are a channel width, a channel length, a capacitance of the insulating film per unit area, and a mobility, respectively.

A discussion on the saturation region show in the equation (1) is given below. The following discussion does not mean that the present invention is not applied to the linear region.

The following discussion is on the saturation region. In the equation (1), the square root of $I_{ds}$ is represented by the following equation.

$$(I_{ds})^{1/2}=(\beta)^{1/2}\times(V_{gs}-V_{th}) \quad (4)$$

As shown in the equation (4) $(I_{ds})^{1/2}$ is proportional to $(V_{gs}-V_{th})$. This means that the square root of the drain current $I_{ds}$ of the driving element Q1 is linear with respect to the gate voltage $V_{gs}$. As is obvious from the equation (4), $V_{gs}$ where $(I_{ds})^{1/2}=0$ is equal to $V_{th}$. The method for defining $V_{th}$ of a TFT based on this relation is generally used. In the present invention, $V_{th}$ of the TFT is calculated by this method.

Figure 3:
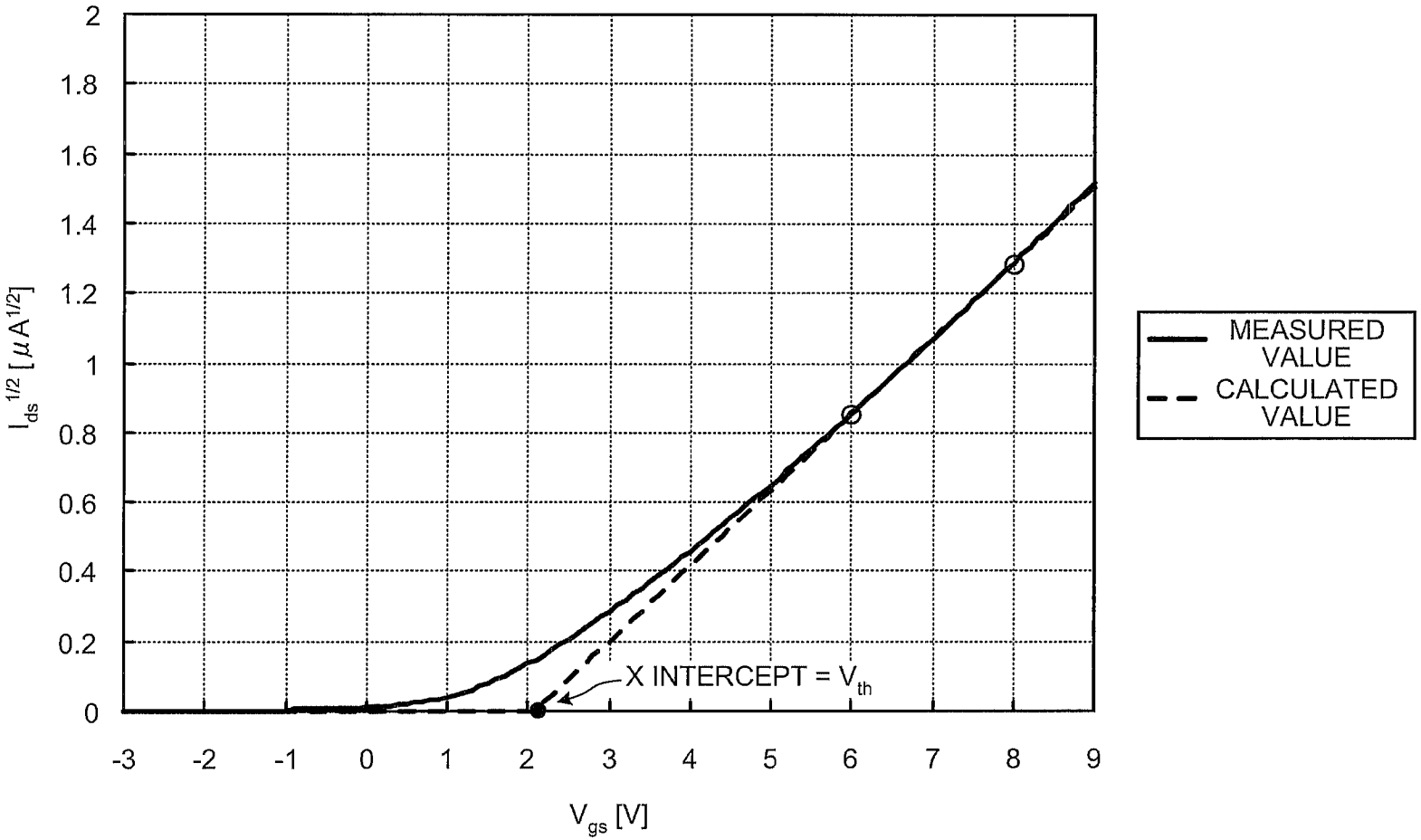
FIG. 3 shows a relation between gate-source voltage $V_{gs}$ and drain-source current $(I_{ds})^{1/2}$ of a driving element Q1 (V-$I^{1/2}$ characteristics).

FIG. 3 shows a relation between gate-source voltage $V_{gs}$ and drain-source current $(I_{ds})^{1/2}$ of the driving element Q1 (V-$I^{1/2}$ characteristics), and an example graph of the drain-source current $(I_{ds})^{1/2}$ when the drain-source voltage $V_{ds}$ is held to 10 (V) and the gate-source voltage $V_{gs}$ is changed between −3 (V) and 9 (V). In FIG. 3, the solid line exemplifies measured values and the dashed line exemplifies calculated values showing the characteristic in accordance with the equation (4).

If it is a general n-type TFT of amorphous silicon, initial $V_{th}$ is 5 (V) or less. $V_{th}$ can be obtained from FIG. 3 as the following calculation. The values of the points represented by white circles in the $(I_{ds})^{1/2}$ characteristic curve of FIG. 3 are $V_{gs}$=6 (V) and 8(V) respectively in x-axis (horizontal axis). The x intercept of the line that pass through the two points is represented by $(I_{ds})^{1/2}=0$ in the equation (4), and so it is $V_{gs}$ where $(V_{gs}-V_{th})=0$. The value of the x intercept is obtained from the graph shown in FIG. 3 as about 2.1 (V). That is, $V_{th}$ of the driving element Q1 is 2.1 (V).

As shown by the solid line of FIG. 3, current flows between drain and source of the driving element Q1 even in a region where the gate-source voltage $V_g$, of the driving element Q1 is $V_{th}$ or less. Accordingly, if the $V_{th}$ detection period is set to be long, $V_{gs}$ is $V_{th}$ or less.

Solutions of the two challenges described above: (1) prevent $V_{th}$ of the driving element from being out of the detection range and (2) equalize the $V_{th}$ shift in every pixel circuit, are explained below.

A method to achieve the above challenges is that voltages for the reverse bias of a predetermined level are applied to the driving elements Q1 of all pixel circuits, when the driving element Q1 is controlled for not emitting, that is, when the light-emitting element is not emitted. Actually, application of voltages for the reverse bias results in a small amount of $V_{th}$ shift. However, this method has the following problem.

For example, if some pixels always show black in the image display device, there is little $V_{th}$ shift of the driving elements Q1 for these pixels because of little current flowing through them, compared with the other pixels. However, $V_{th}$ shift due to the application of the voltages for the reverse bias occurs as in the other pixels, so that the $V_{th}$ shift occurs in the opposite direction (negative direction for n-type, positive direction for p-type). For this reason, such a method that certain amounts of voltages for the reverse bias are applied to all pixel circuits in common results in large variations of $V_{th}$ shift among the pixel circuits, and so uniformity of displayed images is not improved well. Further, in this method, the value of $V_{th}$ may be out of the detection range in some of the pixel circuits because their $V_{th}$ shifts move too much in the opposite direction, and thus appropriate compensation for $V_{th}$ is not performed. In the preparation period, if a voltage applied to the source terminal of the driving element Q1 is $V_p$ ($V_p$>0 for n-type, $V_p$<0 for p-type), the detection range of $V_{th}$ is $0\leq V_{th}\leq V_p$ for n-type and $V_p\leq V_{th}\leq 0$ for p-type. The details are omitted.

In this embodiment, first to third methods described below that include modification to the above method are provided.

First Method

First, a first method is explained. In the first method, in a state where the $V_{th}$ shift is not large, that is, where the $V_{th}$ is lower than a predetermined level for an n-type TFT or where the $V_{th}$ is higher than the predetermined level for a p-type TFT, voltages for the reverse bias are not applied to the driving element Q1. This control prevents the $V_{th}$ from being out of the detection range because of too shift of the $V_{th}$ in the opposite direction.

In the case of an n-type TFT, the predetermined level is set to, for example, 2 V. In this case, since voltages for the reverse bias are not applied if a range of $V_{th}\leq 2$ (V), the $V_{th}$ in a normal use state shifts in the positive direction. Conversely, since voltages for the reverse bias are applied to a predetermined pixel circuit during no emission if a range of $V_{th}>2$ (V), the $V_{th}$ of the pixel circuit shifts in the negative direction. Accordingly, the $V_{th}$ becomes close to 2 (V), thereby resulting in high uniformity. The normal use state described above means such a general use state that a predetermined pixel potential is applied to the pixel circuit to emit light, except for such a specific case that specific pixel circuits always show black.

In the case of a p-type TFT, the predetermined level is set to, for example, −2 (V). In this case, since voltages for the reverse bias are not applied if a range of $V_{th}\geq -2$ (V), the $V_{th}$ in the normal use state shifts in the negative direction. Conversely, since voltages for the reverse bias are applied to a predetermined pixel circuit during no emission if a range of $V_{th}<-2$ (V), the $V_{th}$ of the pixel circuit shifts in the positive direction. Accordingly, the $V_{th}$ becomes close to −2 (V), thereby resulting in high uniformity.

Figure 4:
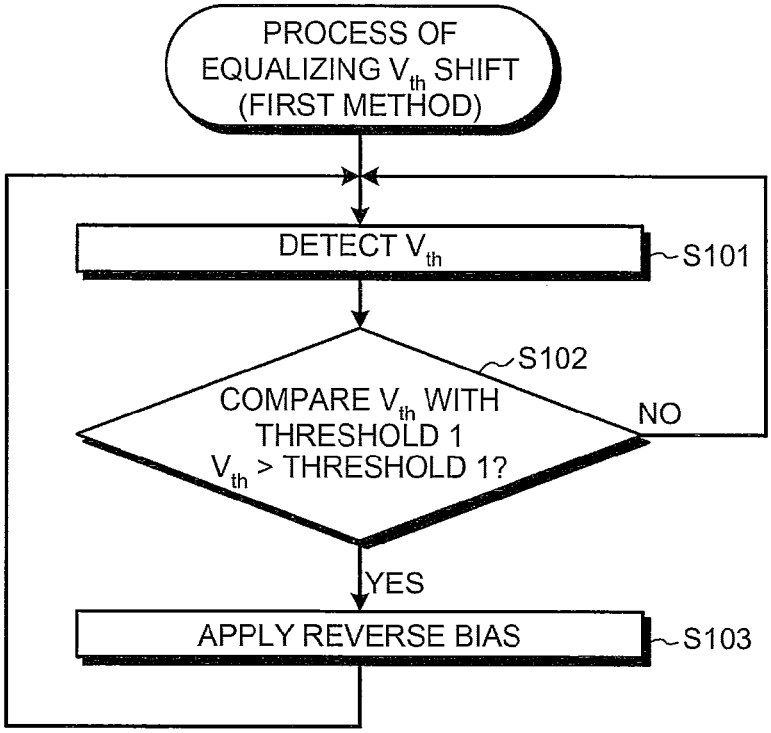
FIG. 4 is a flowchart showing an example of process of equalizing $V_{th}$ shift (a first method).

FIG. 4 is a flowchart showing a process in accordance with the first method described above. The flowchart shown in FIG. 4 shows a case where the driving element Q1 is an n-type transistor.

The controller U1 detects the threshold voltage $V_{th}$ (Step 101), and compares the detected $V_{th}$ with THRESHOLD1 being a first threshold predetermined (Step S102). If the $V_{th}$ is larger than THRESHOLD1 (Yes at Step S102), predetermined voltages for the reverse bias are applied (Step S103), and returning to the process of Step S101, the $V_{th}$ detection is continued. On the other hand, if the $V_{th}$ is equal to or smaller than THRESHOLD1 (No at Step S102), returning to the process of Step S101, the $V_{th}$ detection is continued without applying the voltages for the reverse bias. The process of applying the voltages for the reverse bias is performed in non-emission time of the frame period. In a case where the driving element Q1 is a p-type transistor, at Step S102, if the $V_{th}$ is smaller than THRESHOLD1, predetermined voltages for the reverse bias are applied.

Second Method

Next, a second method is explained. In the second method, in a state where the $V_{th}$ shift is not large, that is, where the $V_{th}$ is lower than a predetermined level for an n-type TFT or the $V_{th}$ is higher than the predetermined level for a p-type TFT, voltages for the forward bias are applied to the driving element Q1. This control prevents $V_{th}$ from being out of the detection range because of too shift of the $V_{th}$ in the opposite direction.

In the case of an n-type TFT, the predetermined level is set to, for example, 2 (V). In this case, since voltages for the forward bias are applied to a predetermined pixel circuit during no emission if a range of $V_{th} \leq 2$ (V), the $V_{th}$ of the pixel circuit shifts in the positive direction. Conversely, since voltages for the forward bias are not applied if a range of $V_{th} > 2$ (V), the $V_{th}$ basically does not shift if it is not in normal use. In the normal use state, since the $V_{th}$ shifts in the positive direction during no application of the voltages for the forward bias, this method may be combined with the first method in order that the $V_{th}$ is close to 2 (V) in view of the period of no application. A method of combining the first method and the second method is described later in a third method.

In the case of a p-type TFT, the predetermined level is set to, for example, −2 (V). In this case, since voltages for the forward bias are applied to a predetermined pixel circuit during no emission if a range of $V_{th} \geq -2$ (V), the $V_{th}$ shifts in the negative direction. Conversely, since voltages for the forward bias are not applied if a range of $V_{th} < -2$ (V), the $V_{th}$ does not shift or shifts in the positive direction. Accordingly, the $V_{th}$ becomes close to −2 (V), thereby resulting in high uniformity.

Figure 5:
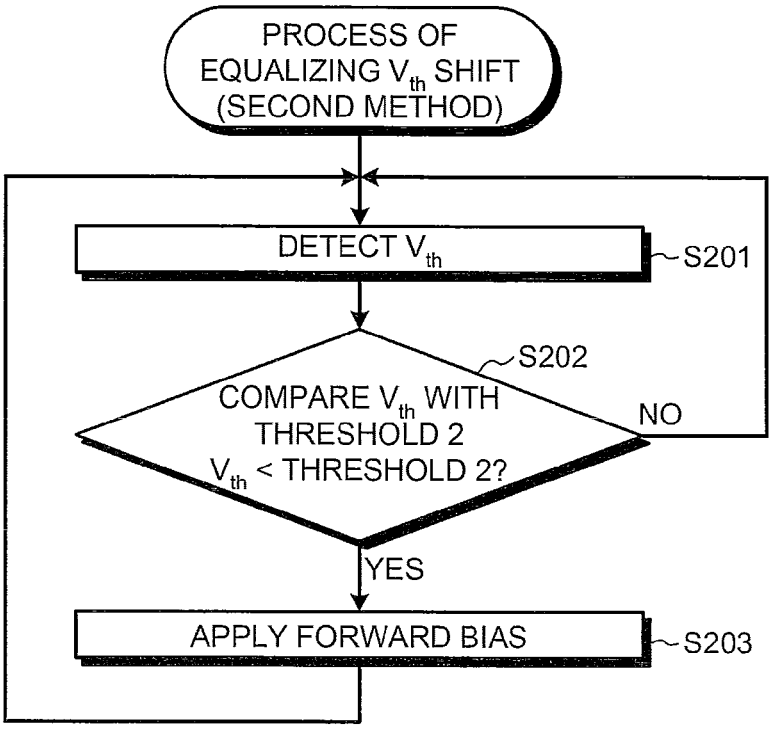
FIG. 5 is a flowchart showing an example of process of equalizing $V_{th}$ shift (a second method).

FIG. 5 is a flowchart showing a process in accordance with the second method described above. The flowchart shown in FIG. 5 shows a case where the driving element Q1 is an n-type transistor.

The controller U1 detects the threshold voltage $V_{th}$ (Step 201), and compares the detected $V_{th}$ with THRESHOLD2 being a second threshold predetermined (Step S202). If the $V_{th}$ is smaller than THRESHOLD2 (Yes at Step S202), predetermined voltages for the forward bias are applied (Step S203), and returning to the process of Step S201, the $V_{th}$ detection is continued. On the other hand, if the $V_{th}$ is equal to or larger than THRESHOLD2 (No at Step S202), returning to the process of Step S201, the $V_{th}$ detection is continued without applying the voltages for the reverse bias. The process of applying the voltages for the forward bias is performed in non-emission time of the frame period. In a case where the driving element Q1 is a p-type transistor, at Step S202, if the $V_{th}$ is larger than THRESHOLD2, predetermined voltages for the forward bias are applied.

Third Method

Next, a third method is explained. This third method is performed by combining the first method and the second method. Specifically, if the driving element Q1 is an n-type TFT, in a state where the $V_{th}$ is higher than a predetermined level, voltages for the reverse bias are applied to the driving element Q1 and in a state where the $V_{th}$ is lower than the predetermined level, voltages for the forward bias are applied to the driving element Q1. If the driving element Q1 is a p-type TFT, in a state where the $V_{th}$ is lower than the predetermined level, voltages for the reverse bias are applied to the driving element Q1, and in a state where the $V_{th}$ is higher than the predetermined level, voltages for the forward bias are applied to the driving element Q1. This control prevents the $V_{th}$ from being out of the detection range because of too shift of the $V_{th}$ in the opposite direction. This control can also prevent an amount of $V_{th}$ shift from being extremely out of a predetermined value.

According to the above explanation, a common criterion value (the predetermine level) is used for determining application of the voltages for the reverse bias and the voltages for the forward bias, but their criterion values may be different from each other.

Figure 6:
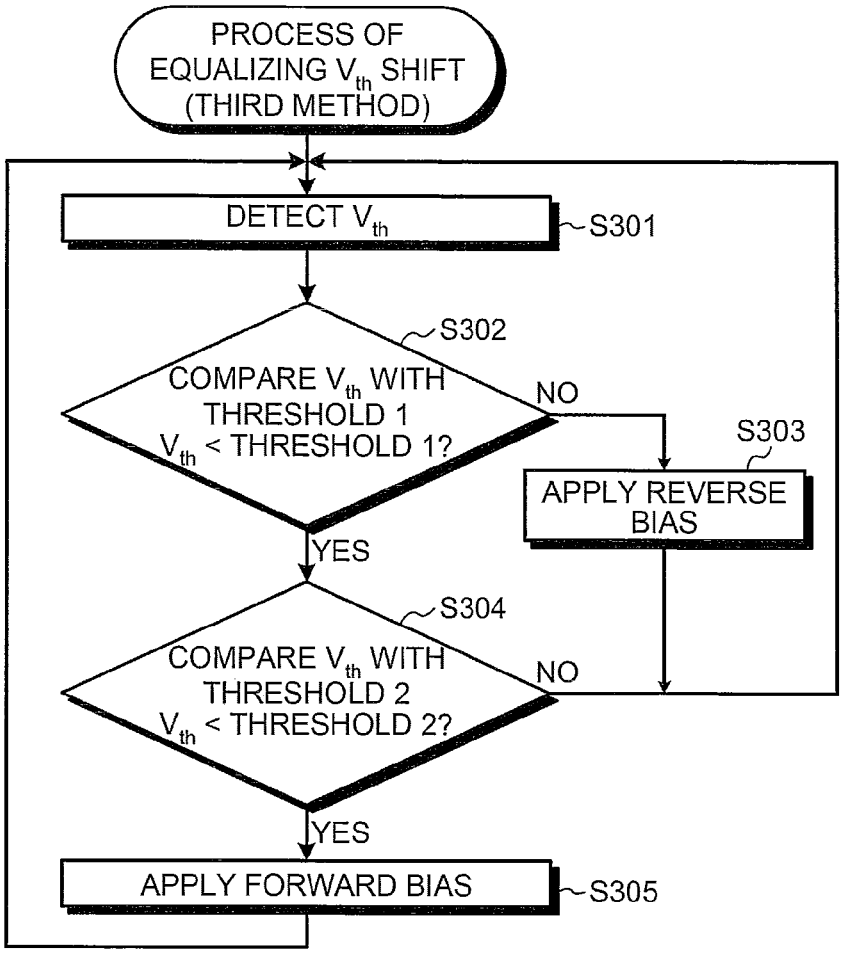
FIG. 6 is a flowchart showing an example of process of equalizing $V_{th}$ shift (a third method).

FIG. 6 is a flowchart showing a process in accordance with the third method described above. The flowchart shown in FIG. 6 shows a case where the driving element Q1 is an n-type transistor.

The controller U1 detects the threshold voltage $V_{th}$ (Step 301), and compares the detected $V_{th}$ with THRESHOLD1 being a first threshold predetermined (Step S302). If the $V_{th}$ is equal to or larger than THRESHOLD1 (No at Step S302), predetermined voltages for the reverse bias are applied (Step S303), and returning to the process of Step S301, the $V_{th}$ detection is continued. On the other hand, if the $V_{th}$ is smaller than THRESHOLD1 (Yes at Step S302), going to a process of Step S304 without applying the voltages for the reverse bias, the detected $V_{th}$ is compared with THRESHOLD2 being a second threshold predetermined (Step S304). If the $V_{th}$ is smaller than THRESHOLD2 (Yes at Step S304), predetermined voltages for the forward bias are applied (Step S305), and returning to the process of Step S301, the $V_{th}$ detection is continued. On the other hand, if the $V_{th}$ is equal to or larger than THRESHOLD2 (No at Step S304), returning to the process of Step S301, the $V_{th}$ detection is continued without applying the voltages for the forward bias. The processes of applying the voltages for the reverse bias and the voltages for the forward bias are performed in non-emission time of the frame period, as in the first method and the second method. In a case where the driving element Q1 is a p-type transistor, at Step S302, if the $V_{th}$ is smaller than THRESHOLD1, predetermined voltages for the reverse bias are applied. At Step S304, if the $V_{th}$ is equal to or larger than THRESHOLD2, predetermined voltages for the forward bias are applied.

Next, the values of the voltages for the reverse bias and the voltages for the forward bias to be applied to the driving element Q1 are explained. To begin with, in the flowcharts shown in FIGS. 4 to 6, the values of the voltages for the reverse bias and the voltages for the forward bias to be applied to the driving element Q1 can be set to fixed values independently of the value of the threshold voltage $V_{th}$. This method has only to control the application of fixed voltages for a reverse or forward bias only based on determination information indicating whether the $V_{th}$ is larger or smaller than a predetermined value, thereby providing an advantage of simplifying the configuration of every pixel circuit.

The values of voltages for the reverse bias and the forward bias to be applied to the driving element Q1 is preferably changed depending on the value of the threshold voltage $V_{th}$. Taking an example, the driving element Q1 is controlled to be applied with a smaller voltage as the $V_{th}$ is larger (in the case of n-type transistor).

Given here are n-type TFTs that are driving elements having $V_{th}$=1 (V) and $V_{th}$=5 (V), respectively. In this case, the driving element having $V_{th}$=1 (V) is applied with, for example, a voltage of $V_{gs}$=2 (V) (in this conditions, $\Delta V1=V_{gs}-V_{th}=1$ (V), and this means a state where the voltages for a forward bias are applied). On the other hand, the driving element having $V_{th}$=5 (V) is applied with, for example, a voltage of $V_{gs}$=3 (V) (in this conditions, $\Delta V2=V_{gs}-V_{th}=-2$ (V), and this means a state where the voltages for a reverse bias are applied).

Given here are p-type TFTs that are driving elements having $V_{th}$=−1 (V) and $V_{th}$=−5 (V), respectively. In this case, the driving element having $V_{th}$=−1 (V) is applied with, for example, a voltage of $V_{gs}$=−2 (V) (in this conditions, $\Delta V1=V_{gs}-V_{th}=-1$ (V), and this means a state where the voltages for a forward bias are applied). On the other hand, the driving element having $V_{th}$=−5 (V) is applied with, for example, a voltage of $V_{gs}$=−3 (V) (in this conditions, $\Delta V2=V_{gs}-V_{th}=2$ (V), and this means a state where the voltages for a reverse bias are applied).

In other words, the control is performed that a voltage $V_{gs}$ whose absolute value is larger is applied to the driving element having the threshold voltage $V_{th}$ whose absolute value is large, than that applied to the driving element having the threshold voltage $V_{th}$ whose absolute value is small.

If the control is performed that the voltage to be applied to the driving element Q1 is changed depending on the value of the threshold voltage $V_{th}$ as described above, the configuration of every pixel circuit becomes complicated. However, this control is simplified by a method. An example of the method is explained below with reference to FIGS. 10 to 12.

Figure 10:
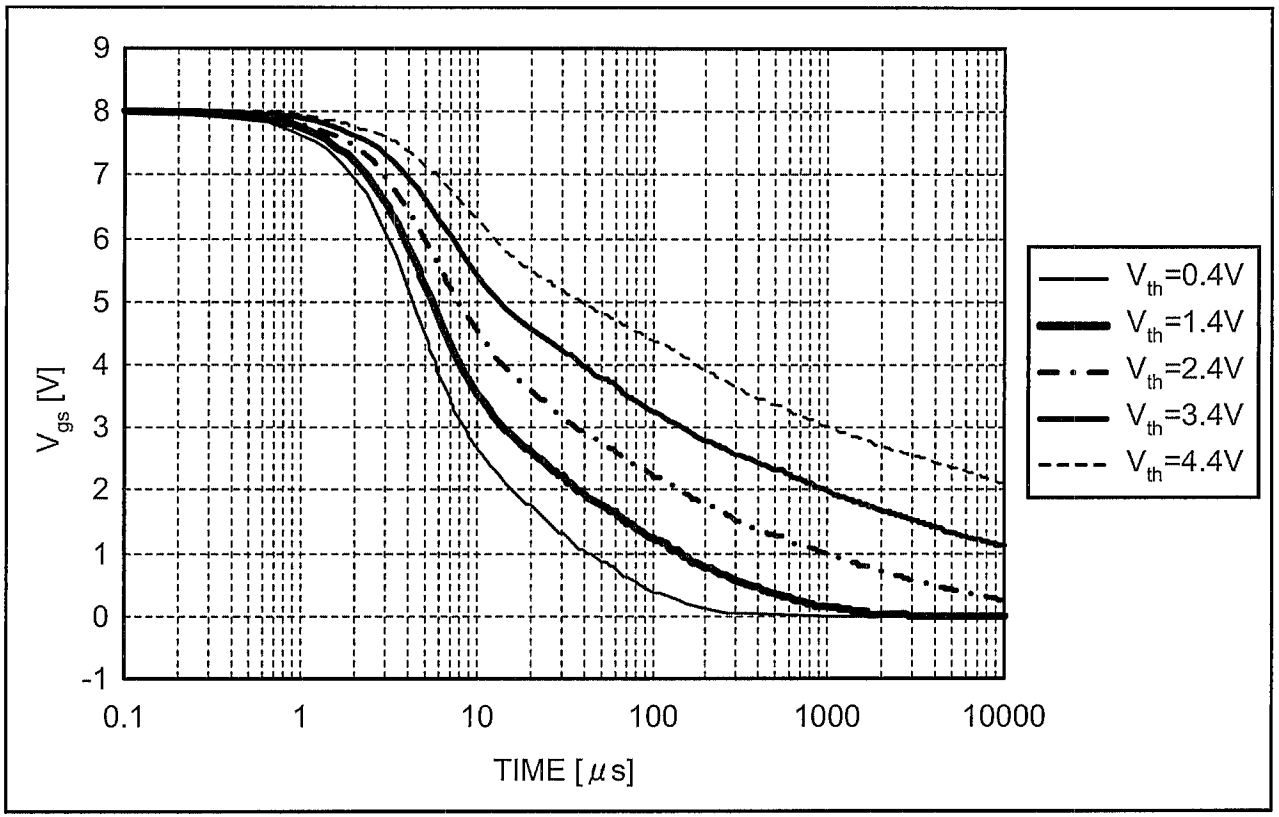
FIG. 10 is a graph showing a relation between gate-source voltage $V_{gs}$ of a driving element and detection time at the time of detecting $V_{th}$.
Figure 11:
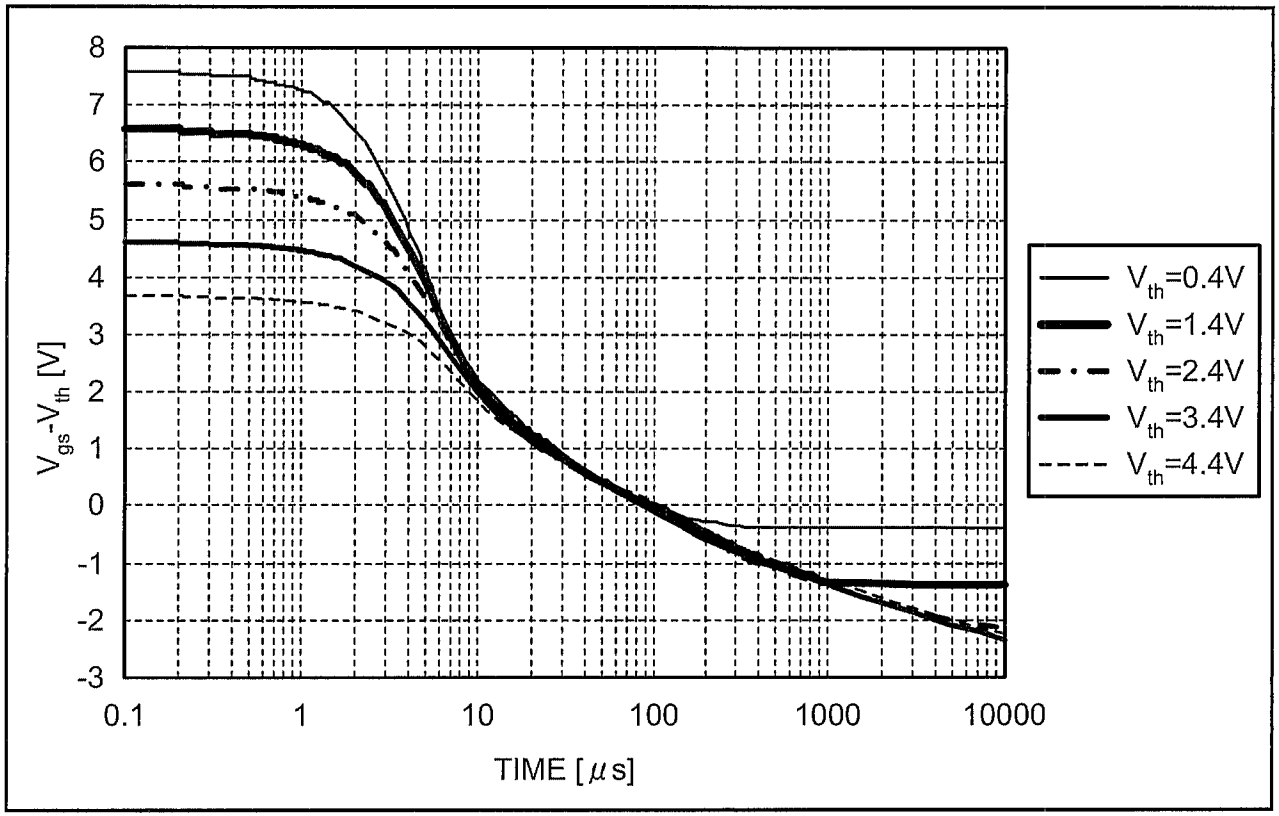
FIG. 11 is a graph in which the vertical axis of the graph of FIG. 10 shows voltage difference between gate-source voltage $V_{gs}$ and threshold voltage $V_{th}$.
Figure 12:
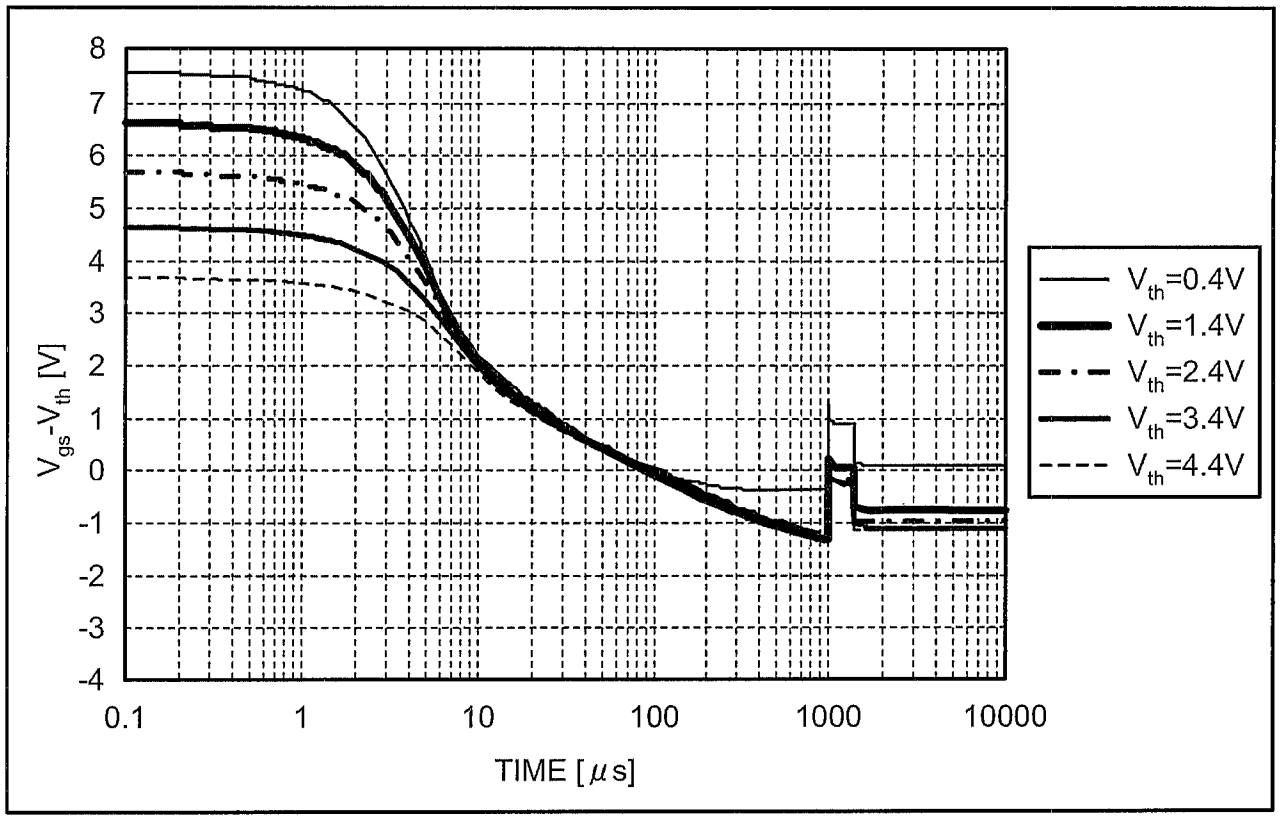
FIG. 12 is a graph showing changes in gate-source voltage $V_{gs}$ when the potential of an image signal line is increased and decreased by one method according to the present invention.

FIG. 10 is a graph showing a relation between gate-source voltage $V_{gs}$ of the driving element Q1 and detection time at the time of detecting $V_{th}$; and FIG. 11 is a graph in which the vertical axis of the graph of FIG. 10 shows voltage difference between gate-source voltage $V_{gs}$ and threshold voltage $V_{th}$. FIG. 12 is a graph showing changes in gate-source voltage $V_{gs}$ when the potential of the image signal line (included in the controller U1 of FIG. 1 but not shown) is increased from 8 V to 10 V at completion of detecting $V_{th}$ (1000 μs) and when the potential of the image display line is decreased to 9 V in 400 μs after the increasing.

In FIG. 12, the curve of $V_{th}$=0.4 (V) shows that $V_{gs}-V_{th}$ is a voltage of equal to or larger than 0 (V) in the period of 400 μs during which the potential of the image display device is changed, and it turns out that voltages for a forward bias are applied. On the other hand, the curve of $V_{th}$=2.4 V to 4.4 V shows that $V_{gs}-V_{th}$ is a voltage of equal to or smaller than 0 (V) in the period of 400 μs during which the potential of the image display device is changed, and it turns out that voltages for a reverse bias are applied. The curve of $V_{th}$=1.4 (V) shows that $V_{gs}-V_{th}$ is approximately 0 (V) in the same period, and it turns out that voltages for a forward bias or reverse bias are applied.

In other words, the method described above forms a state where smaller voltages (voltages for a reverse bias) are applied for a group of high $V_{th}$s ($V_{th}$=2.4 (V) to 4.4 (V)), a state where larger voltages (voltages for a forward bias) are applied for a group of low $V_{th}$s ($V_{th}$=0.4 (V)), and a state where a voltage that is an intermediate value between the high-$V_{th}$ group and the low-$V_{th}$ group is applied for a group therebetween ($V_{th}$=1.4 (V)). The reason this control is performed is because the time for detecting $V_{th}$ is relatively long. Such a long $V_{th}$ detection time allows the use of characteristics that a detection value for the low-$V_{th}$ group reaches 0 (V) and a detection value for the high-$V_{th}$ group reaches $V_{th}-x$ (x is a given value).

Figure 7:
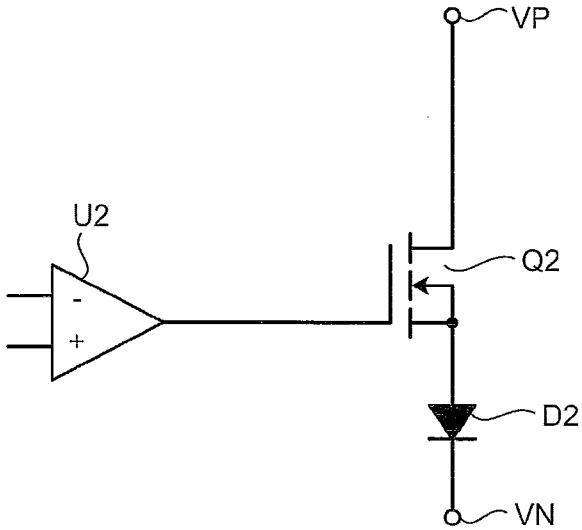
FIG. 7 shows an example configuration of a pixel circuit different from that shown in FIG. 1.

FIG. 7 shows an example configuration of a pixel circuit different from that shown in FIG. 1. The pixel circuit shown in FIG. 7 has the same as or similar to the configuration of the image display device shown in FIG. 1, except that a light-emitting element D2 is connected to the source terminal of a driving element Q2. Further, the image display device shown in FIG. 7 has a "voltage control" configuration as that of FIG. 1 in which the gate terminal of the driving element Q2 is controlled, and is called "gate control and source drive".

The methods described above can be applied to the image pixel shown in FIG. 7, and thus it has the same advantages as those of the pixel circuit of FIG. 1. A controller U2 includes, for example, one or more TFTs, capacitive elements such as capacitors, control lines for control of the TFT, and image signal lines for application of an image signal potential.

Figure 8:
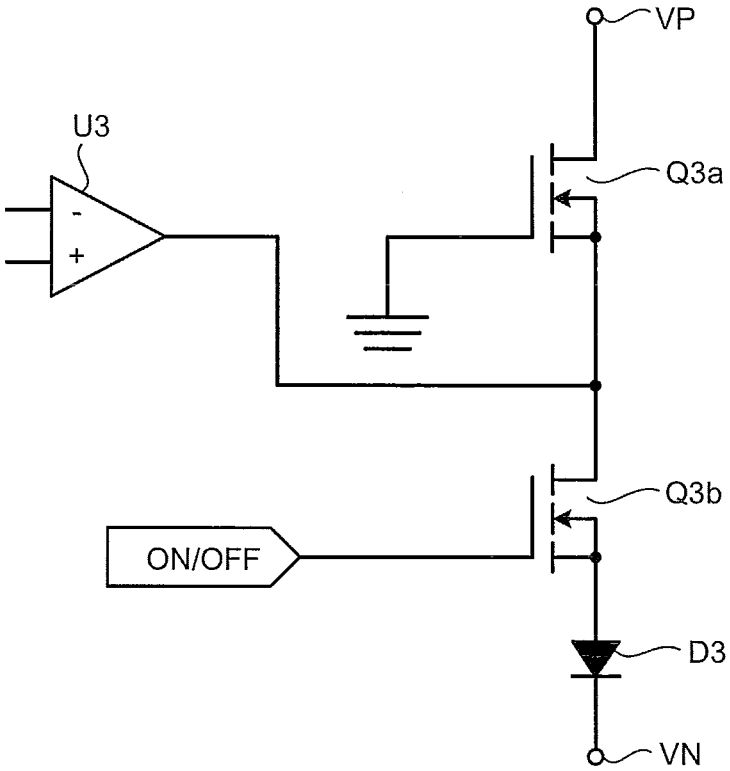
FIG. 8 shows an example configuration of a pixel circuit different from those shown in FIGS. 1 and 7.

FIG. 8 shows an example configuration of a pixel circuit different from those shown in FIGS. 1 and 7. In the pixel circuit shown in FIG. 8, a light-emitting element D3 is connected to the source terminal of a driving element Q3*a* as in FIG. 7, and the difference is that the gate terminal of the driving element Q3*a* is grounded and current flowing at the source terminal of the driving element Q3*a* is controlled by a controller U3. The switching element Q3*b* is a switching element for disconnecting the driving element Q3*a* and the light-emitting element D3 to write a gate-source voltage of the driving element Q3*a*. The image display device shown in FIG. 8 has a "current control" configuration in which the source terminal of the driving element Q3*a* is controlled, and is called "source control and source drive". The controller U3 includes, for example, one or more TFTs, capacitive elements such as capacitors, control lines for control of the TFT, and image signal lines for application of an image signal potential.

Similarly to the pixel circuits of FIGS. 1 and 7, the pixel circuit shown in FIG. 8 cannot avoid the problems of deterioration due to the $V_{th}$ shift of the driving element and of reduced image uniformity due to uneven deterioration. Accordingly, the solutions described above can be applied to the pixel circuit shown in FIG. 8 and provide the same advantages as those of the pixel circuits of FIGS. 1 and 7.

Figure 9:
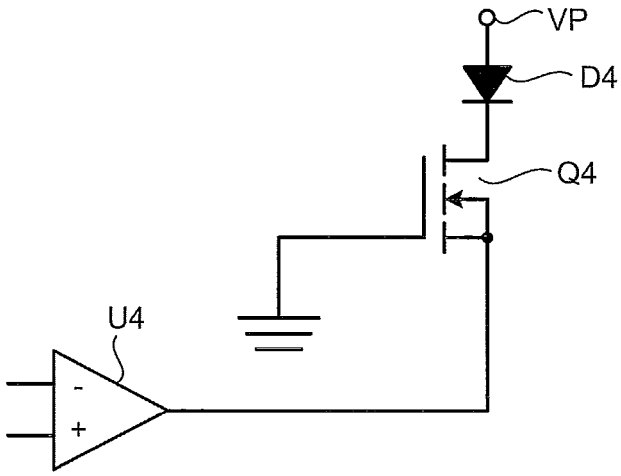
FIG. 9 shows an example configuration of a pixel circuit different from those shown in FIGS. 1, 7, and 8.

FIG. 9 shows an example configuration of a pixel circuit different from those shown in FIGS. 1, 7, and 8. In the pixel circuit shown in FIG. 9, a light-emitting element D4 is connected to the source terminal of a driving element Q4 as in FIG. 1, and the difference is that the gate terminal of the driving element Q4 is grounded and current flowing at the source terminal of the driving element Q4 is controlled by a controller U4. The image display device shown in FIG. 9 has a "voltage control" configuration in which the source terminal of the driving element Q3*a* is controlled, and is called "source control and source drive". The controller U3 includes, for example, one or more TFTs, capacitive elements such as capacitors, control lines for control of the TFT, and power supplies lines.

Similarly to the pixel circuits of FIGS. 1, 7 and 8, the pixel circuit shown in FIG. 9 cannot avoid the problems of deterioration due to the $V_{th}$ shift of the driving element and of reduced image uniformity due to uneven deterioration. Accordingly, the solutions described above can be applied to the pixel circuit shown in FIG. 9 and provide the same advantages as those of the pixel circuits of FIGS. 1, 7 and 8.

INDUSTRIAL APPLICABILITY

As described above, an image display device and a driving method for the same are useful as invention that equalizes an amount of shift in $V_{th}$ for each pixel.

The invention claimed is:

1. An image display device comprising:

a plurality of pixel circuits, each pixel circuit having a light-emitting element that emits light corresponding to current flowing therethrough;

a driving element that is connected to the light-emitting element and controls light emission of the light-emitting element; and a control unit that applies voltages for a reverse or forward bias to the driving element based on a threshold voltage of the driving element determined at a specific time and a predetermined threshold voltage when the light-emitting element does not emit light, the control unit configured to:

apply a reverse bias voltage to an n-type driving element as a result of the determined threshold voltage of the n-type driving element at the specific time being equal to or higher than a first positive predetermined voltage level, apply a forward bias voltage to the n-type driving element as a result of the determined threshold voltage of the n-type driving element at the specific time being lower than a second positive predetermined voltage level, apply a reverse bias voltage to a p-type driving element as a result of the determined threshold voltage of the p-type driving element at the specific time being lower than a first negative predetermined voltage level, and apply a forward bias voltage to the p-type driving element as a result of the determined threshold voltage of the p-type driving element at the specific time being equal to or higher than a second negative predetermined voltage level, wherein the threshold voltage of the driving element included in the each pixel circuit becomes close to the predetermined threshold voltage.

2. The image display device according to claim 1, wherein the first positive predetermined voltage level is higher than the second positive predetermined voltage level, and the first negative predetermined voltage level is lower than the second negative predetermined voltage level.

3. A driving method of an image display device that comprises a plurality of pixel circuits, each pixel circuit having a light-emitting element that emits light corresponding to current flowing therethrough, and a driving element that is connected to the light-emitting element and controls light emission of the light-emitting element, the driving method comprising:

applying voltages for a reverse or forward bias to the driving element based a threshold voltage of the driving element determined at a specific time and a predetermined threshold voltage when the light-emitting element does not emit light;

applying a reverse bias voltage to an n-type driving element as a result of the determined threshold voltage of the n-type driving element at the specific time being equal to or higher than a first positive predetermined voltage level;

applying a forward bias voltage to the n-type driving element as a result of the determined threshold voltage of the n-type driving element at the specific time being lower than a second positive predetermined voltage level;

applying a reverse bias voltage to a p-type driving element as a result of the determined threshold voltage of the p-type driving element at the specific time being lower than a first negative predetermined voltage level; and applying a forward bias voltage to the p-type driving element as a result of the determined threshold voltage of the p-type driving element at the specific time being equal to or higher than a second negative predetermined voltage level, wherein the threshold voltage of the driving element included in the each pixel circuit becomes close to the predetermined threshold voltage.

4. The driving method according to claim 3, wherein the first positive predetermined voltage level is higher than the second positive predetermined voltage level, and the first negative predetermined voltage level is lower than the second negative predetermined voltage level.

* * * * *